US010429065B2

(12) United States Patent
Garloch et al.

(10) Patent No.: US 10,429,065 B2
(45) Date of Patent: Oct. 1, 2019

(54) LOW $NO_x$ GAS BURNERS WITH CARRYOVER IGNITION

(71) Applicant: Carrier Corporation, Farmington, CT (US)

(72) Inventors: Duane D. Garloch, Westfield, IN (US); Brian A. Reeves, Indianapolis, IN (US); Robert Shaw, Indianapolis, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 132 days.

(21) Appl. No.: 15/091,765

(22) Filed: Apr. 6, 2016

(65) Prior Publication Data

US 2016/0290634 A1 Oct. 6, 2016

Related U.S. Application Data

(60) Provisional application No. 62/143,520, filed on Apr. 6, 2015.

(51) Int. Cl.

| | |
|---|---|
| ***F23D 14/04*** | (2006.01) |
| ***F23D 14/46*** | (2006.01) |
| ***F23D 9/00*** | (2006.01) |
| ***F23Q 9/00*** | (2006.01) |
| ***F23D 23/00*** | (2006.01) |

(52) U.S. Cl.

CPC ..... *F23D 14/04* (2013.01); *F23D 14/46* (2013.01); *F23D 23/00* (2013.01); *F23Q 9/00* (2013.01); *F23D 2207/00* (2013.01)

(58) Field of Classification Search

CPC ..... F23D 14/04; F23D 23/00; F23D 14/46; F23D 2207/00

USPC ..... 126/25 B, 286, 191, 192, 193

See application file for complete search history.

(56) References Cited

U.S. PATENT DOCUMENTS

| | | | | |
|---|---|---|---|---|
| 3,938,945 | A * | 2/1976 | Riehl | F23D 14/045 431/191 |
| 5,833,449 | A | 11/1998 | Knight et al. | |
| 6,860,734 | B2 | 3/2005 | Zia et al. | |
| 6,880,548 | B2 | 4/2005 | Schultz et al. | |
| 6,923,643 | B2 | 8/2005 | Schultz et al. | |
| 7,494,337 | B2 | 2/2009 | Specht et al. | |
| 7,690,375 | B2 | 4/2010 | Ricord et al. | |

(Continued)

FOREIGN PATENT DOCUMENTS

WO 2014116970 A2 7/2014

*Primary Examiner* — Avinash A Savani
*Assistant Examiner* — Rabeeul I Zuberi
(74) *Attorney, Agent, or Firm* — Cantor Colburn LLP

(57) ABSTRACT

A burner assembly is provided including a plurality of burners. Each burner includes a burner tube having an inlet, an outlet, and a burner axis. A partition plate is arranged generally perpendicular to a horizontal plane defined by the plurality of burner axes. The partition plate includes a plurality of partition openings complementary to and arranged coaxially with the plurality of burners. An igniter is located near the plurality of burners and is configured to ignite a fuel and air mixture provided at the outlet of the burners. An ignited carryover includes a substantially identical first opening and second opening formed in the partition plate adjacent the igniter. The first opening and second openings are sized such that a sufficient amount of the fuel and air mixture reaches the igniter without cooling the igniter.

11 Claims, 10 Drawing Sheets

(56) References Cited

U.S. PATENT DOCUMENTS

| | | | |
|---|---|---|---|
| 8,167,610 | B2 | 5/2012 | Raleigh et al. |
| 8,591,222 | B2 | 11/2013 | Sherrow |
| 8,616,194 | B2 | 12/2013 | Sherrow et al. |
| 8,668,489 | B2 | 3/2014 | Chiappetta et al. |
| 8,858,225 | B2 | 10/2014 | Hiraga |
| 8,875,693 | B2 | 11/2014 | Irvin |
| 8,939,759 | B2 | 1/2015 | Mori |
| 2010/0291501 | A1 | 11/2010 | Smit |
| 2012/0178032 | A1 | 7/2012 | Roy et al. |
| 2012/0240917 | A1 | 9/2012 | Tolleneer |
| 2013/0089826 | A1 | 4/2013 | Mori |
| 2013/0252185 | A1 | 9/2013 | Shaw et al. |
| 2014/0034038 | A1 | 2/2014 | Sherrow |

* cited by examiner

LOW $NO_x$ GAS BURNERS WITH CARRYOVER IGNITION

CROSS-REFERENCE TO RELATED APPLICATIONS

This application claims the benefit of U.S. provisional patent application Ser. No. 62/143,520, filed Apr. 6, 2015, the entire contents of which are incorporated herein by reference.

BACKGROUND OF THE INVENTION

The subject matter disclosed herein relates to heating systems. More specifically, the subject disclosure relates to burners for residential and commercial heating systems.

Heating systems, in particular furnaces, include one or more burners for combusting a fuel such as natural gas. Hot flue gas from the combustion of the fuel proceeds from the burner and through a heat exchanger. The hot flue gas transfers thermal energy to the heat exchanger, from which the thermal energy is then dissipated by a flow of air driven across the heat exchanger by, for example, a blower.

A typical prior art construction is shown in FIG. 1. A burner 100 is located external to a heat exchanger 102. The burner 100, often referred to as an inshot burner 100, receives a flow of fuel from a fuel source 104. An ignition source 106 combusts the flow of fuel to create a combustion flame 110.

Another type of burner is a premix burner in which fuel and air are mixed in a burner inlet tube prior to injection into a combustion zone 112 where the ignition source 106 ignites the mixture. Premix burners, compared to inshot burners, typically emit much lower levels of $NO_x$, the emissions of which are tightly regulated and restricted by many jurisdictions. Because of this advantage of premix burners, it may be desirable to utilize premix burners in furnaces.

In multi-burner applications such as furnaces, each heat exchanger is supplied with hot combustion products by individual burners. Typically only one burner contains an igniter and upon ignition, the remaining burners are lit form the single burner with the igniter. Flame carryover is the ability to transfer the flame from one burner to the next. For in-shot burner applications, a small channel is formed by the top and bottom plates between adjacent burners such that a small flame transfers hot gases to light each successive burner. Because premix burners are fabricated individually and not by adjoining plates, the carryover between adjacent burners must be achieved in another way. In addition, there is a need to optimize the carryover path so that a sufficient amount of hot gas is transferred to light an adjacent burner without affecting the heating efficiency of the furnace.

BRIEF DESCRIPTION OF THE INVENTION

According to one aspect of the invention, a burner assembly is provided including a plurality of burners. Each burner includes a burner tube having an inlet, an outlet, and a burner axis. A partition plate is arranged generally perpendicular to a horizontal plane defined by the plurality of burner axes. The partition plate includes a plurality of partition openings complementary to and arranged coaxially with the plurality of burners. An igniter is located near the plurality of burners and is configured to ignite a fuel and air mixture provided at the outlet of the burners. An ignited carryover includes a substantially identical first opening and second opening formed in the partition plate adjacent the igniter. The first opening and second openings are sized such that a sufficient amount of the fuel and air mixture reaches the igniter without cooling the igniter.

In addition to one or more of the features described above, or as an alternative, in further embodiments the partition plate includes at least one carryover opening formed between adjacent partition openings. The at least one carryover opening is configured to transmit a flame between the plurality of burners.

In addition to one or more of the features described above, or as an alternative, in further embodiments the at least one carryover opening extends through the entire thickness of the partition plate.

In addition to one or more of the features described above, or as an alternative, in further embodiments a distal end of the at least one carryover opening is spaced away from an adjacent partition opening.

In addition to one or more of the features described above, or as an alternative, in further embodiments a distal end of the at least one carryover opening is fluidly connected to an adjacent partition opening.

In addition to one or more of the features described above, or as an alternative, in further embodiments the at least one carryover is generally rectangular in shape.

In addition to one or more of the features described above, or as an alternative, in further embodiments a distal end of the at least one carryover opening extends generally perpendicular to the horizontal plane.

In addition to one or more of the features described above, or as an alternative, in further embodiments the first opening and the second opening are equidistantly spaced about the horizontal plane.

According to yet another embodiment of the invention, a partition plate is provided including a body having a plurality of partition openings complementary to and arranged coaxially with a plurality of burner axes. The body of the partition plate extends perpendicular to a horizontal plane defined by the plurality of burner axes. A plurality of carryover openings is disposed between adjacent partition openings. The carryover openings are configured to transmit a flame between the plurality of partition openings. A distal end of the plurality of carryover openings extends generally perpendicular to the horizontal plane.

In addition to one or more of the features described above, or as an alternative, in further embodiments the plurality of carryover openings are generally I-shaped.

In addition to one or more of the features described above, or as an alternative, in further embodiments the plurality of carryover openings are generally bone-shaped.

In addition to one or more of the features described above, or as an alternative, in further embodiments the distal end of the plurality of carryover openings is spaced away from an adjacent partition opening.

In addition to one or more of the features described above, or as an alternative, in further embodiments the distal end of the plurality of carryover openings is fluidly connected to an adjacent partition opening.

In addition to one or more of the features described above, or as an alternative, in further embodiments the partition plate has an igniter carryover including a substantially identical first opening and second opening. The first opening and the second opening are sized such that a sufficient amount of a fuel and air mixture provided at one of the plurality of partition openings reaches an adjacent igniter without cooling the igniter.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
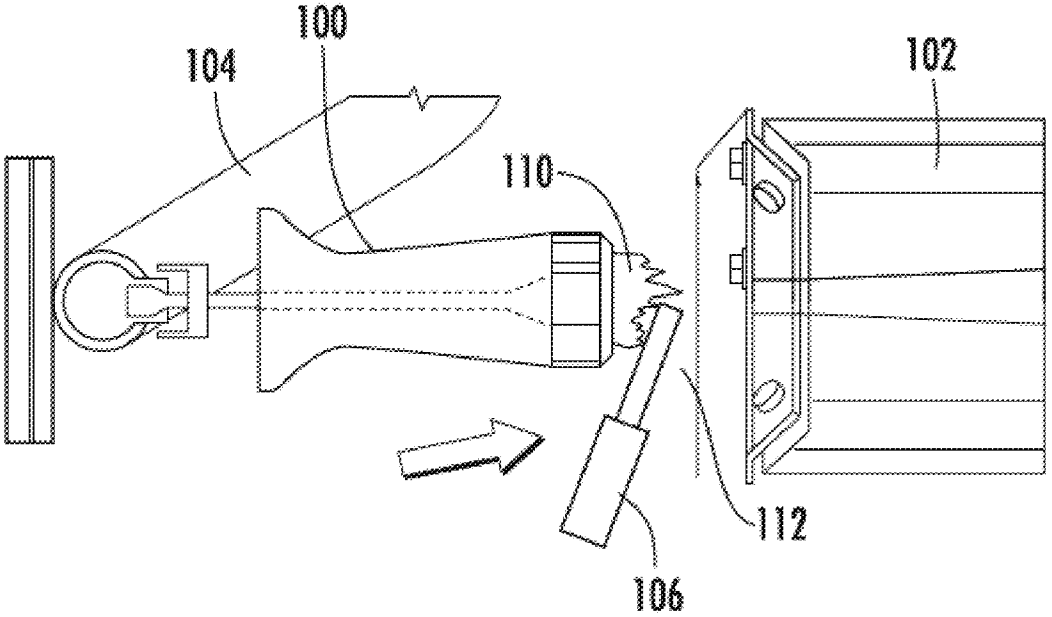
FIG. 1 PRIOR ART
FIG. 1 is a cross-sectional view of an example of a typical prior art burner arrangement.
Figure 2:
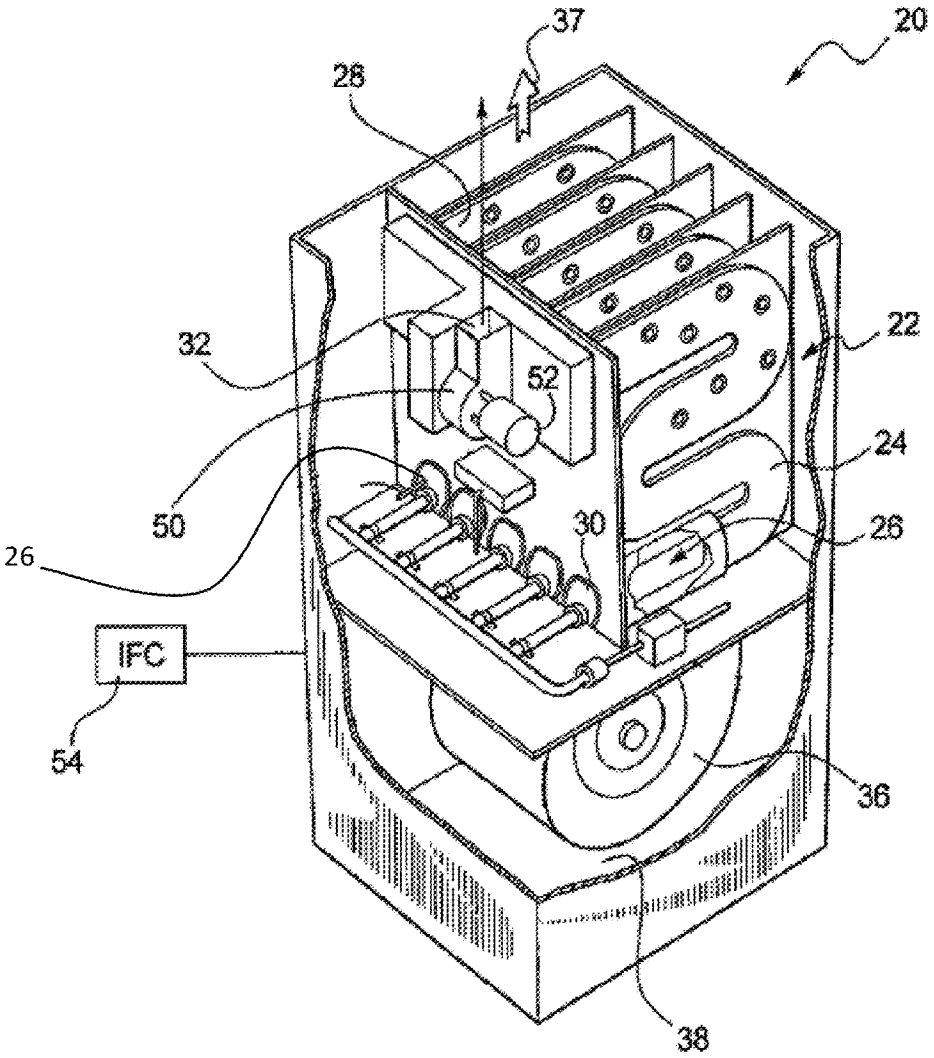
FIG. 2 is a schematic view of an embodiment of a furnace.

Referring now to FIG. 2, an improved furnace 20 is illustrated. The furnace 20 may include a heat exchanger 22 having a plurality of individual heat exchanger coils 24. The heat exchanger coils 24, which may be metallic conduits, may be provided in a serpentine fashion to provide a large surface area in a small overall volume of space, the importance of which will be discussed in further detail below. Each heat exchanger coil 24 includes an inlet 26 and outlet 28. A burner 30 is operatively associated with each inlet 26, and a vent 32 is operatively associated with each outlet 28. The burner 20 introduces a flame and combustion gases (not shown) into the heat exchanger coil 24, while vent 32 releases the combustion gases to atmosphere (through a flue or the like) after the heat of the flame and combustion gases is extracted by the heat exchanger 22.

In order to extract the heat, a blower motor 36 may be provided to create a significant air flow across the heat exchanger coils 24. As the air circulates across the coils 24, it is heated and can then be directed to a space to be heated such as a home or commercial building for example, by way of appropriate ductwork as indicated by arrow 37. The furnace 20 may also include a return 38 to enable air from the space to be heated to be recirculated and/or fresh air to be introduced for flow across the heat exchanger coils 24.

To generate the flame and hot combustion gases, the burners 30 pre-mix fuel and air and then ignite the same. The fuel may be natural gas or propane and may be introduced by a fuel orifice or jet 42 (FIG. 4) positioned at an inlet of the burner inlet tube 63. The burner 30 includes a burner tube 61 having an inlet 60 and an outlet 48. A portion or substantially all of the air and fuel for combustion is introduced into the burner 30 through inlet 60. Such air may be introduced by inducing an airflow using a motorized induction fan 50 downstream of the burner outlet 48. More specifically, a motor 52 having the fan 50 associated therewith may be operatively associated with the outlets 28 of the heat exchanger coils 24. When energized, the fan 50 may rotate and induce an air flow through the heat exchanger coils 24 and burners 30. Control of the motor 52, may be controlled by a processor 54 such as an integrated furnace control (IFC).

Figure 3:
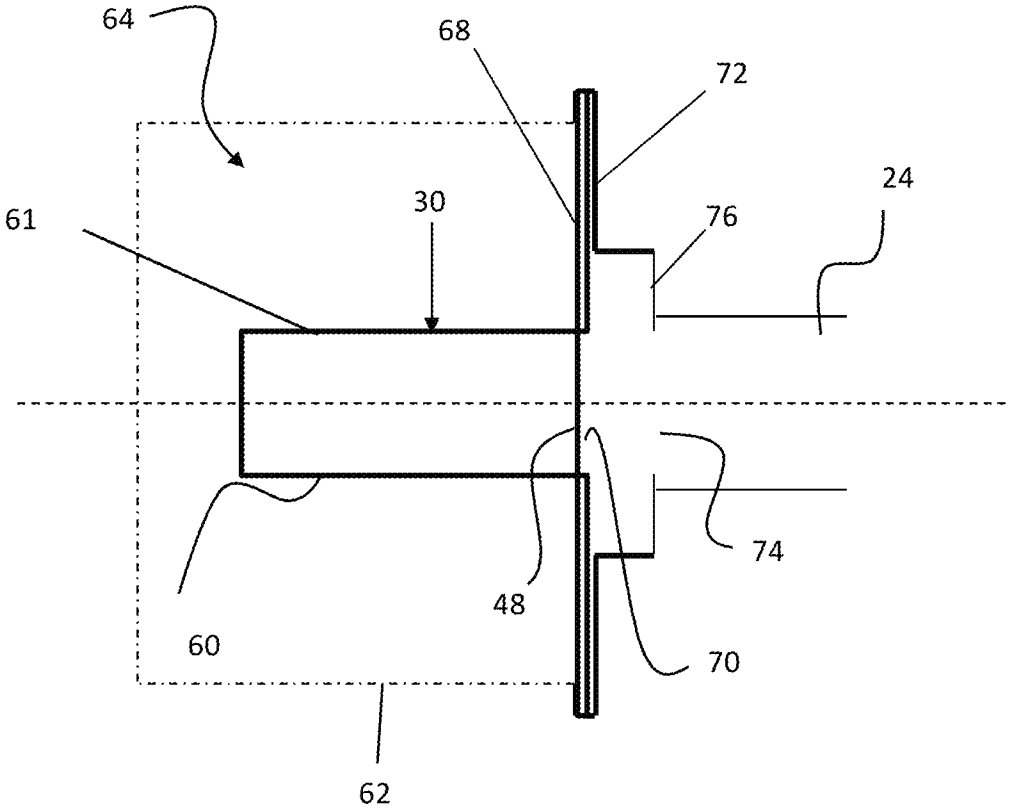
FIG. 3 is a partially exploded view of a burner box according to an embodiment of the invention.
Figure 4:
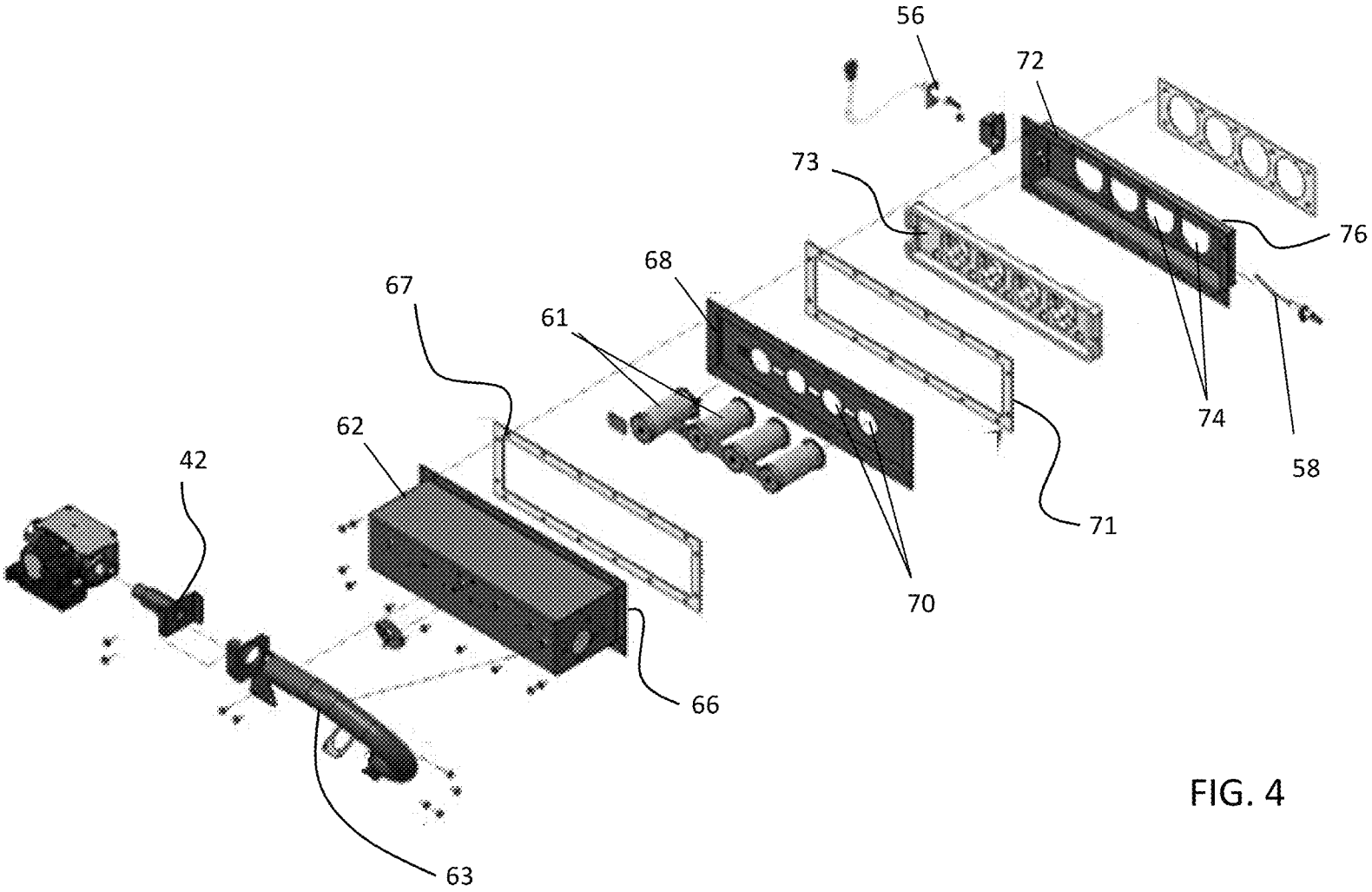
FIG. 4 is a fully exploded view of a burner box according to an embodiment of the invention.

Referring now to FIGS. 3-4, the burners 30 are illustrated in more detail. As indicated above, each burner 30 includes a burner tube 61 having an inlet formed generally about a circumference thereof and an outlet 48. However, the burner tube 61 may be provided in other configurations as well. For example, while depicted as a cylindrical tube of constant diameter, the burner tube 61 may be provided as a restricted diameter section or a venturi, among other variations.

Each or all of the plurality of burners 30 may be arranged within a mixing chamber 64 of the outer box 62. Fuel supplied by the fuel jet 42 and air drawn by inducer fan 50 are premixed and supplied to the mixing chamber 64 prior to ignition. The burners 30 may additionally include a mixer (not shown) which is used to decrease lean blow-off and increase the stability of the flame. To light the burners 30, at least one igniter 56 (see FIG. 4) is located near the burners 30, generally between the burner outlet 48 and the heat exchanger 22 to ignite the fuel/air mixture.

The burners 30 are positioned within a mixing chamber 64 of the outer box 62 such that the outlet 48 of the burner 30 is adjacent an open end 66 of the box 62. Connected to the open end 66 of the box 62 and the outlet end 48 of each of the plurality of burners 30 is a partition plate 68. A gasket 67 may be arranged between a portion of the open end 66 of box 62 and the partition plate 68 to provide a seal there between. The partition plate 68 has a plurality of openings 70 formed therein, each of which is substantially aligned with and fluidly coupled to the outlet 48 of a corresponding burner 30. In another embodiment, a portion of the burner tubes 61 may extend through the openings 70 formed in the partition plate 68.

An inner box 72 is coupled to the partition plate 68, opposite the outer box 62. A gasket 71 may similarly be arranged between a portion partition plate 68 and the inner box 72 to form a seal there between. In an embodiment, the inner box 72 may be integrated with the partition plate 68. The inner box 72 also includes a plurality of openings 74, each of which is substantially aligned with and fluidly coupled to an opening 70 formed in the partition plate 68 and the outlet 48 of a corresponding burner 30. The individual heat exchanger coils 24 are positioned adjacent an exterior surface 76 of the inner box 72, in line with the plurality of openings 74, such that a fluid flow path extends from the burner outlet 48 through the partition plate 68 and inner box 72 into the heat exchanger coils 24. In the illustrated, non-limiting embodiment of FIG. 4, a refractory panel 73 is arranged between a portion of the partition plate 68 and the inner box 72. The refractory panel 73 is configured to protect not only the adjacent surface of the inner box 72, but also the interface between the inner box 72 and the heat exchanger coils 24, from overheating.

To reduce the number of components in the system, and therefore both complexity and cost, it is desirable to use a single igniter 56 to light a first burner 30 and then have that ignition carried over to each of the plurality of burners 30 in succession. A flame sensor 58 (FIG. 4), generally aligned with the igniter 56, may be disposed on an opposite side of the burners 30 than the igniter 56. The flame sensor 58 is configured to determine if the ignition has carried over to each of the plurality of burners 30 by sensing the presence of a flame at the burner 30 furthest from the igniter 56. With reference now to FIGS. 5-10, this carryover between the plurality of burners 30 is achieved by forming one or more carryover openings 80 between each of the pairs of adjacent partition openings 70 in the partition plate 68. In an embodiment, the carryover openings 80 extend fully through the thickness of the partition plate 68.

Figure 5:
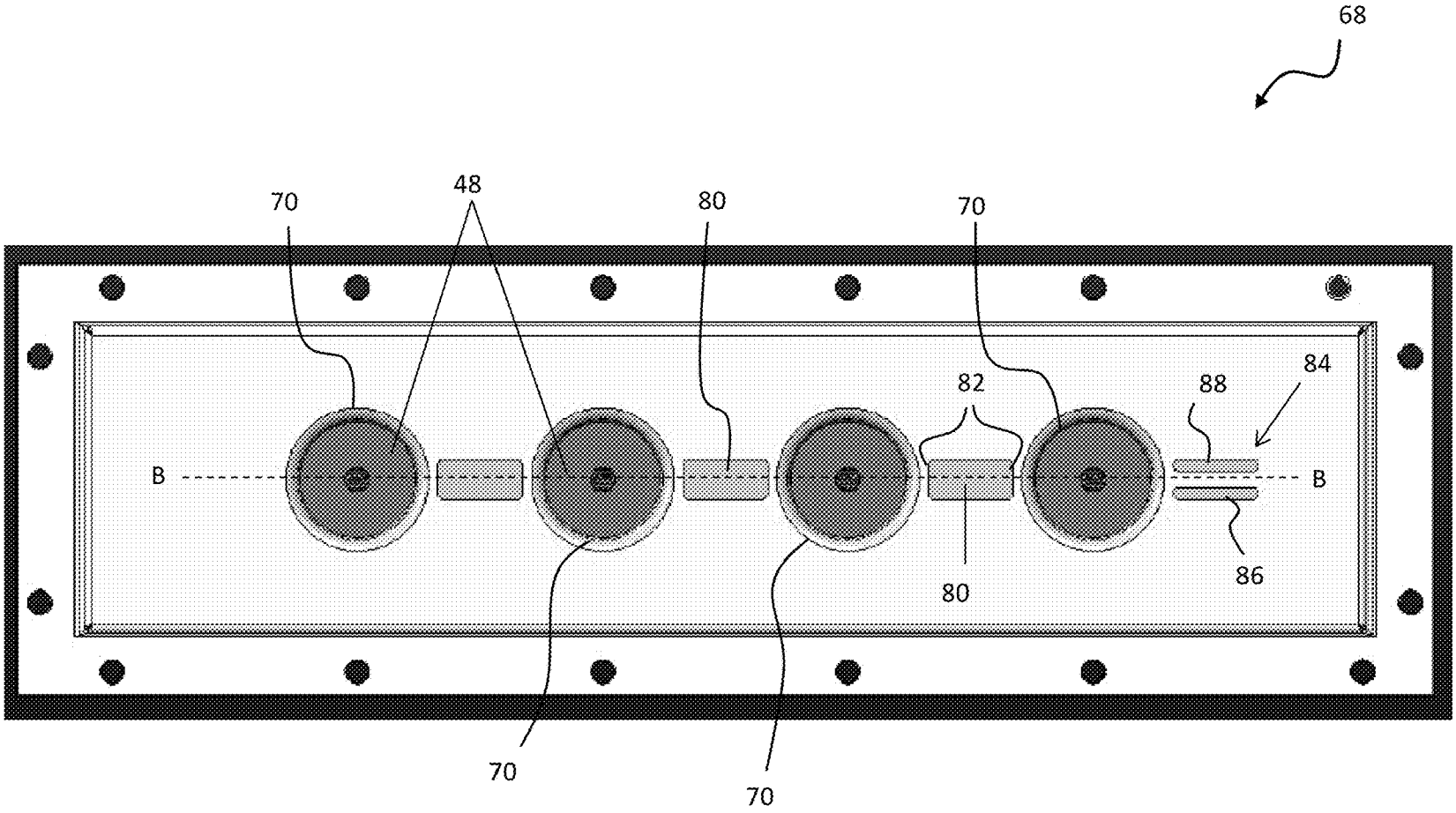
FIG. 5 is a front view of a partition plate of the burner box having at least one carryover opening according to an embodiment of the invention.
Figure 6:
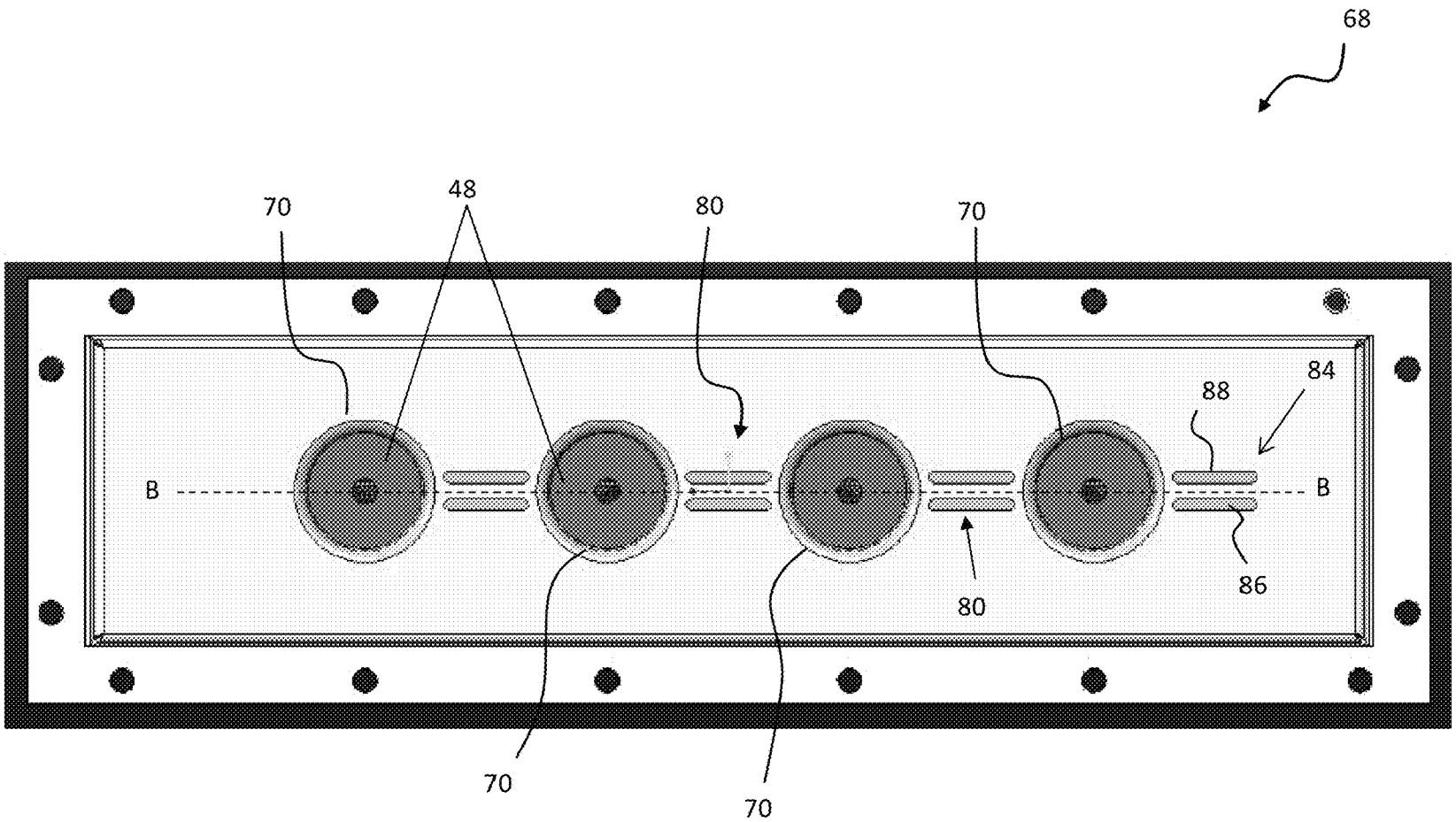
FIG. 6 is a front view of another partition plate of the burner box having at least one carryover opening according to an embodiment of the invention.
Figure 7:
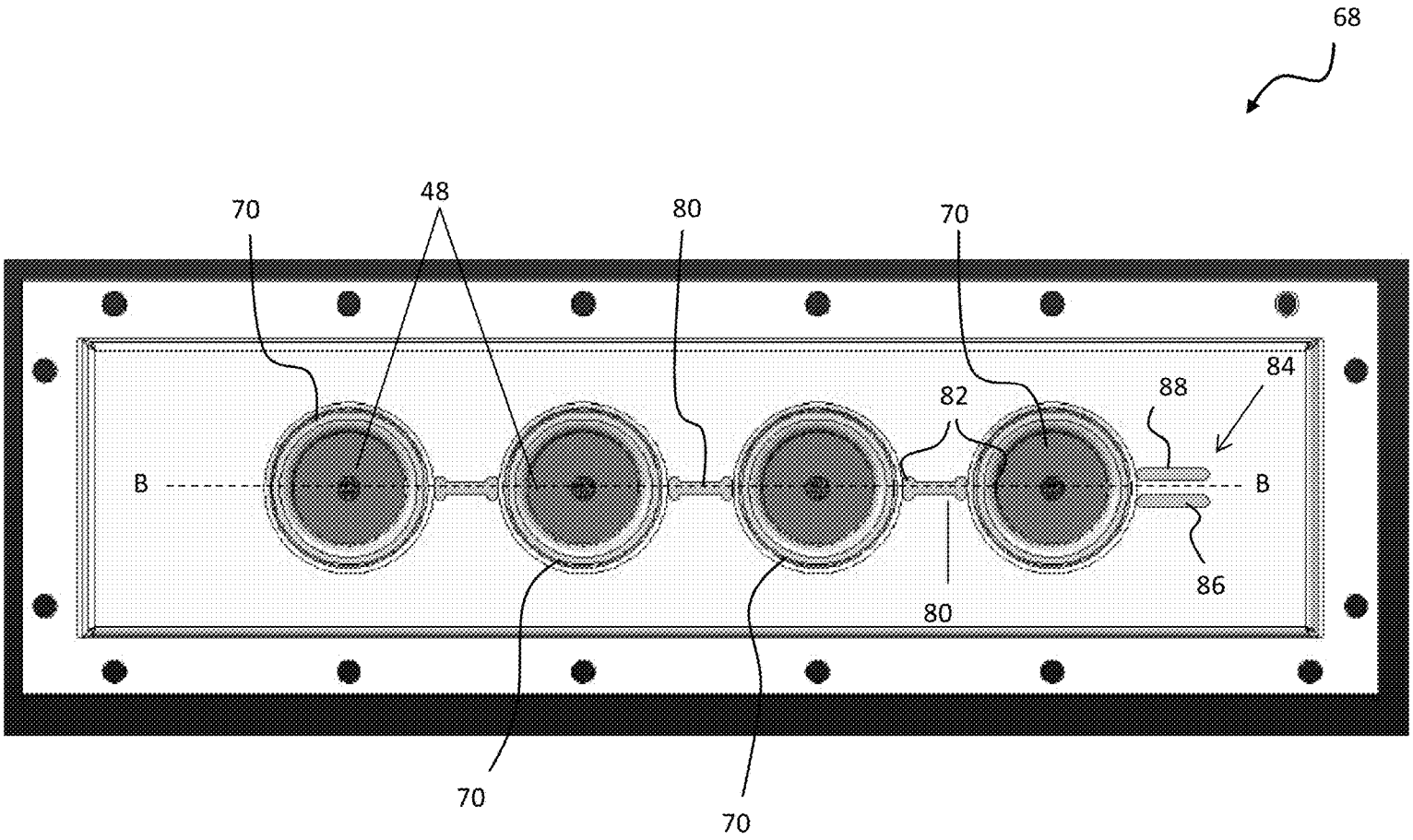
FIG. 7 is a front view of yet another partition plate of the burner box having at least one carryover opening according to an embodiment of the invention.
Figure 8:
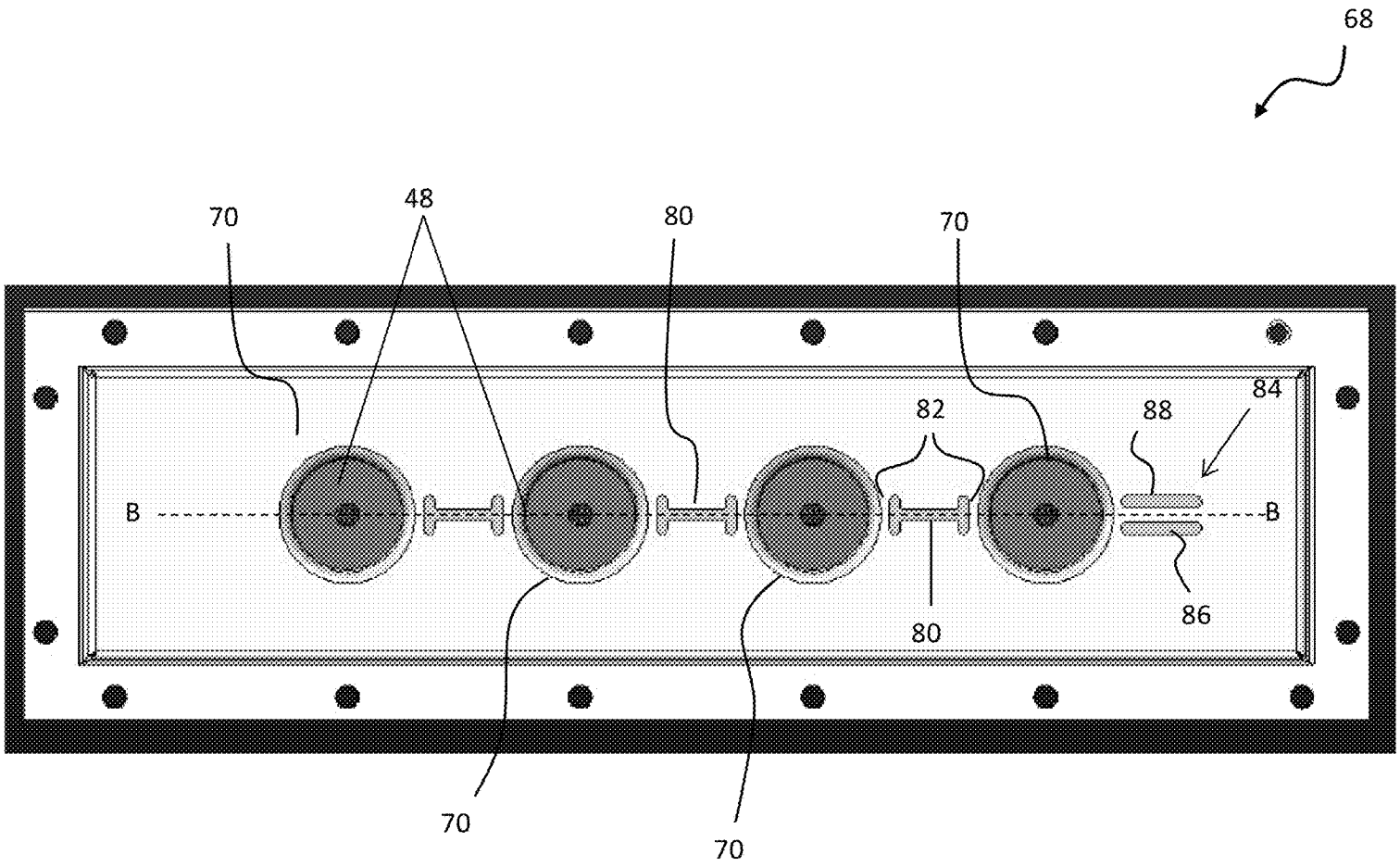
FIG. 8 is a front view of another partition plate of the burner box having at least one carryover opening according to an embodiment of the invention.
Figure 9:
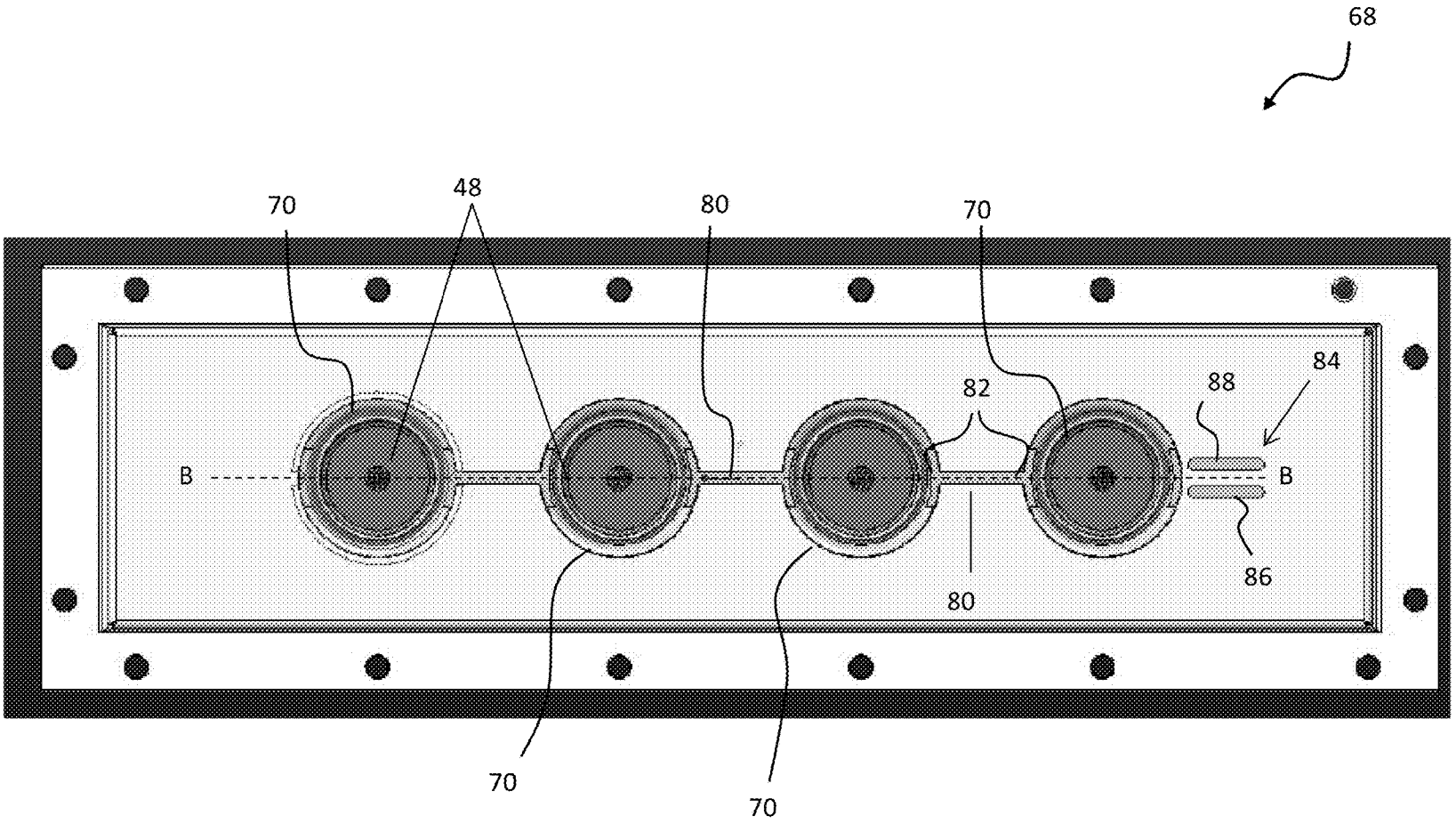
FIG. 9 is a front view of another partition plate of the burner box having at least one carryover opening according to an embodiment of the invention.

The carryover openings 80 are generally centered about the horizontal plane B containing each of the parallel burner axes. Although the plurality of carryover openings 80 formed in the partition plate 68 in each of the illustrated embodiments are substantially identical, a partition plate 68 having two or more carryover openings 80 of varying geometry are within the scope of the invention. In some embodiments, as shown in FIGS. 8 and 9, the length of a carryover opening 80 extends in at least one direction to directly couple the opening 80 to at least one of the adjacent partition openings 70. However, in other embodiments, such as shown in FIGS. 5-7 for example, the distal ends 82 of the carryover openings 80 may be separated from the partition openings 70 by a distance.

The shape and size of the carryover openings 80 is selected to provide a sufficient flow of hot flue and combustion gases from one burner 30 to an adjacent burner 30 when the system 20 is run at both nominal and extreme operating conditions. Accordingly, the carryover openings 80 may be formed having any of a variety of shapes and sizes. The embodiments illustrated and disclosed herein are intended as examples only, and it should be understood that other embodiments are within the scope of the invention. In one embodiment, illustrated in FIG. 5, rectangular openings having a first height are formed between and separated from the adjacent partition openings. Similarly, rectangular openings having a substantially reduced height are also within the scope of the invention. In one embodiment, as illustrated in FIGS. 7 and 8, the distal ends of the carryover openings 80 may extend generally perpendicular to the horizontal plane B containing the burner axes. The height of the distal ends 82 relative to the length of the openings 80 may also vary, for example to form a bone-like shape (FIG. 7) and an I-like shape (FIG. 8).

Figure 10:
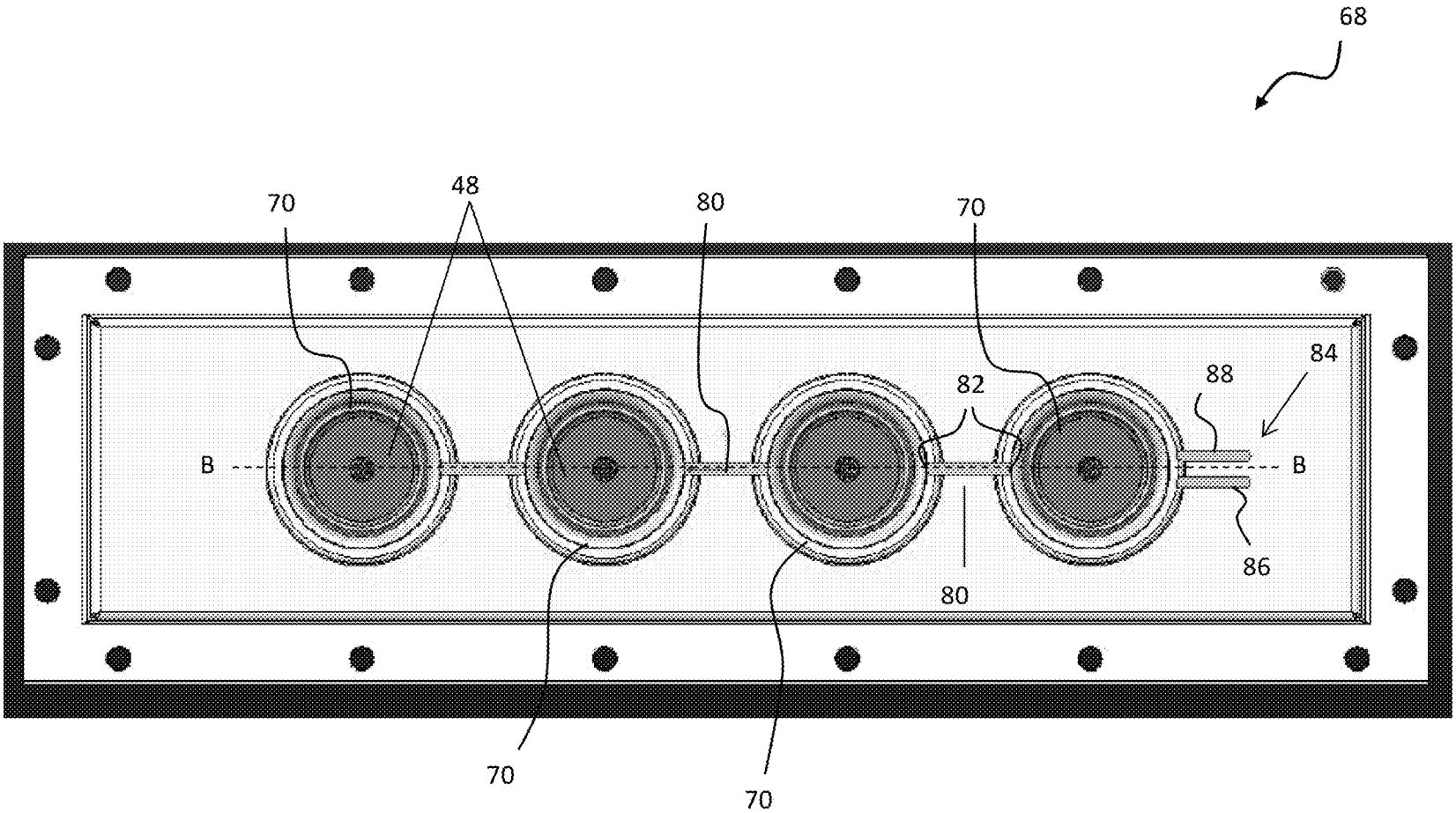
FIG. 10 is a front view of yet another partition plate of the burner box having at least one carryover opening according to an embodiment of the invention.

In yet another embodiment, as shown in FIGS. 9, and 10, the periphery of one or more of the partition openings 70 formed in the partition plate 68 is embossed. As a result, the flow from the burner outlet 48 at each partition opening 70 is directed towards an adjacent carryover opening 80, thereby improving the flow between adjacent burners 30.

To enhance the initial ignition of a first burner 30, an igniter carryover opening 84 is similarly formed in the plate adjacent the igniter 56. In the illustrated, non-limiting embodiment, the igniter carryover opening 84 includes a substantially identical first and second opening 86, 88 arranged on opposing sides of the horizontal plane B defined by the plurality of burner axes. By forming two openings 86, 88 adjacent the igniter 56, the amount of fuel/gas mixture that reaches the igniter 56 is sufficient for ignition. However, the amount of the premixed combustion gases provided to the igniter 56 should be limited. The premixed combustion gases are generally cool in temperature, and when supplied in excess, these gases may be sufficient to cool the igniter 56, such that the igniter 56 is no longer capable of igniting the gases and creating a flame.

The system 20 disclosed herein allows for the utilization of a premix burner 30, while not subjecting the heat exchanger 22 surfaces to direct effects of the combustion to prevent thermal damage to the heat exchanger 22. However, the present invention is not limited to premix burners, and may be used in conjunction with other burner types. In addition, inclusion of the carryover openings 80, 84 as described herein provide a mechanism by which the flame or hot combustion gases of one burner can be used to light each of the plurality of burners in succession. In doing so, a single igniter 56 can be used to ignite all of the burners 30. Accordingly, the expense of providing individual igniters 56 and flame sensors 58 for each burner 30 is avoided, thereby reducing both manufacturing and maintenance costs.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A burner assembly, comprising a plurality of burners, each burner including a burner tube having an inlet and an outlet and a burner axis;

a partition plate arranged generally perpendicular to a horizontal plane defined by the plurality of burner axes, the partition plate including:

a plurality of partition openings complementary to and arranged coaxially with the plurality of burners, wherein a periphery of at least one of the plurality of partition openings is embossed;

a plurality of carryover openings formed in the partition plate between the plurality of partition openings, wherein each of the plurality of carryover openings includes a first end and a second end, the first end and the second end extending perpendicular to a horizontal plane containing the burner axis of each of the plurality of burners, the plurality of carryover openings being arranged in fluid communication with the embossed periphery of at least one of the plurality of partition openings such that a flow is directed between the embossed periphery and at least one of the plurality of carryover openings;

an igniter located adjacent a side of the partition plate near the plurality of burners, the igniter being configured to ignite a fuel and air mixture provided at the outlet of the burners; and an igniter carryover formed in the partition plate in alignment with the igniter at a position between an end of the partition plate and an adjacent partition opening of the plurality of partition openings, the igniter carryover including a substantially identical first opening and second opening, the first opening and the second opening being sized such that a sufficient amount of the fuel and air mixture reaches the igniter without cooling the igniter.

2. The burner assembly according to claim 1, wherein the plurality of carryover openings extend through the entire thickness of the partition plate.

3. The burner assembly according to claim 1, wherein at least one of the first end and the second end of the at least one carryover opening is spaced away from an adjacent partition opening.

4. The burner assembly according to claim 3, wherein at least one of the first end and the second end of the at least one carryover opening is fluidly connected to an adjacent partition opening.

5. The burner assembly according to claim 1, wherein the at least one carryover is generally rectangular in shape.

6. The burner assembly according to claim 5, wherein the first opening and the second opening are equidistantly spaced about the horizontal plane.

7. A partition plate, comprising:

a body including a plurality of partition openings complementary to and arranged coaxially with a plurality of burner axes, a periphery of at least one of the plurality of partition openings being embossed, wherein the body of the partition plate extends perpendicular to a horizontal plane defined by the plurality of burner axes;

a plurality of carryover openings disposed between adjacent partition openings configured to transmit a flame between the plurality of partition openings, wherein each of the plurality of carryover openings includes a first end and a second end, the first end and the second end extending perpendicular to a horizontal plane containing the burner axis of each of the plurality of burners, at least one of the plurality of carryover openings is arranged in fluid communication with the embossed periphery of at least one of the plurality of partition openings such that a flow is between the embossed periphery and at least one of the plurality of carryover openings; and an igniter carryover formed in the body at a position between an end of the body and an adjacent partition opening, the igniter carryover including a substantially identical first opening and second opening, the first opening and the second opening being sized such that a sufficient amount of a fuel and air mixture provided at one of the plurality of partition openings reaches an igniter aligned with the igniter carryover without cooling the igniter.

8. The partition plate according to claim 7, wherein the plurality of carryover openings are generally I-shaped.

9. The partition plate according to claim 7, wherein the plurality of carryover openings are generally bone-shaped.

10. The partition plate according to claim 7, wherein the distal end of the plurality of carryover openings is spaced away from an adjacent partition opening.

11. The partition plate according to claim 7, wherein the distal end of the plurality of carryover openings is fluidly connected to an adjacent partition opening.

* * * * *